US007406826B2

(12) United States Patent
Hayashi et al.

(10) Patent No.: US 7,406,826 B2
(45) Date of Patent: Aug. 5, 2008

(54) VARIABLE-THROAT EXHAUST TURBOCHARGER AND METHOD FOR MANUFACTURING CONSTITUENT MEMBERS OF VARIABLE THROAT MECHANISM

(75) Inventors: Noriyuki Hayashi, Nagasaki (JP); Seiichi Ibaraki, Nagasaki (JP); Yasuaki Jinnai, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/509,636

(22) Filed: Aug. 25, 2006

(65) Prior Publication Data

US 2007/0068155 A1 Mar. 29, 2007

(30) Foreign Application Priority Data

Aug. 25, 2005 (JP) ..... 2005-243829

(51) Int. Cl.
*F02D 23/00* (2006.01)
*F01D 17/16* (2006.01)
*B21K 25/00* (2006.01)

(52) U.S. Cl. ..... 60/602; 415/160; 29/889.2

(58) Field of Classification Search ..... 60/602; 415/160–166; 29/889.2
See application file for complete search history.

(56) References Cited

U.S. PATENT DOCUMENTS 4,557,704 A * 12/1985 Ito et al. ..... 464/181
5,747,428 A * 5/1998 Khorramian ..... 508/151
5,851,659 A * 12/1998 Komuro et al. ..... 428/336
6,669,442 B2 * 12/2003 Jinnai et al. ..... 415/160
6,763,587 B2 7/2004 Jinnai et al.
2002/0098081 A1 * 7/2002 Ertl et al. ..... 415/163
2002/0119042 A1 * 8/2002 Yoshimura et al. ..... 415/164
2002/0168262 A1 * 11/2002 Jinnai ..... 415/164
2005/0011192 A1 1/2005 Ohishi
2005/0169748 A1 * 8/2005 Metz et al. ..... 415/160
2005/0252210 A1 * 11/2005 Shiraishi et al. ..... 60/602
2006/0062663 A1 * 3/2006 Figura et al. ..... 415/160
2006/0134455 A1 * 6/2006 Belhadjhamida et al. .... 428/668
2007/0130943 A1 * 6/2007 Sausse et al. ..... 60/602

FOREIGN PATENT DOCUMENTS

JP 2002-285804 10/2002
JP 2002-332856 11/2002

* cited by examiner

*Primary Examiner*—Thomas Denion
*Assistant Examiner*—Mary A Davis
(74) *Attorney, Agent, or Firm*—Wenderoth, Lind & Ponack, L.L.P.

(57) ABSTRACT

A variable-throat exhaust turbocharger has a variable throat mechanism that reduces wear of contact surfaces of connection pin parts formed integral with lever plates or a drive ring and the grooves into which the connection pin parts are engaged. A mechanism also prevents slipping out of the drive ring from a nozzle mount toward the lever plate to prevent a probable occurrence of failure in action of the variable throat mechanism caused by the slipping out of the drive ring. The connection pin parts connecting between the lever plates and drive ring of the variable throat mechanism are formed integral with either the lever plates or the drive ring by extrusion or by precision casting. At least the connection pin parts or grooves into each of which each of the connection pin parts, is engaged, are treated with surface hardening including diffusion coating.

5 Claims, 5 Drawing Sheets

VARIABLE-THROAT EXHAUST TURBOCHARGER AND METHOD FOR MANUFACTURING CONSTITUENT MEMBERS OF VARIABLE THROAT MECHANISM

BACKGROUND OF THE INVENTION

1. Field of the Invention

The present invention is applied to exhaust turbochargers for internal combustion engines and relates to the construction of a drive ring and lever plates of a variable-throat exhaust turbocharger equipped with a variable throat mechanism for varying the blade angle of a plurality of nozzle vanes and to an assembling method of the variable throat mechanism.

2. Description of the Related Art

There has been proposed an art relating to the construction of a drive ring and lever plates of a variable-throat turbocharger equipped with a variable throat mechanism for varying the blade angle of a plurality of nozzle vanes in Japanese Laid-Open Patent Application No. 2002-285804(hereafter referred to as patent literature 1) applied for by the applicant of the present invention. There is also known Japanese Laid-Open Patent Application No. 2002-332866(hereafter referred to as patent literature 2).

In the art disclosed in patent literature 1, the turbocharger comprises a plurality of nozzle vanes rotatably supported by a nozzle mount fixed to a turbine casing and a variable throat mechanism which comprises an annular drive ring rotatable by means of an actuator, and lever plates. Each of the lever plates has a groove at its one end side to be engaged with connection pins of the drive ring to be connected thereto. The blade angle of the nozzle vanes is varied by rotating the drive ring to swing each of the lever plates, the blade angle being varied by the swing of the lever plates. The connection pin or pins are formed either on the lever plate or on the drive ring by extrusion or by precision casting such that the connection pin or pins are formed in one piece with the parent material, i.e. the lever plate or drive ring.

In the art disclosed in patent literature 2, the turbocharger comprises variable blade angle nozzle vanes for adjusting the flow rate of the exhaust gas exhausted from an engine and introduced into the turbocharger to rotate the turbine rotor. A turbine frame rotatably supports the variable blade angle nozzle vanes arranged at the peripheral part of the exhaust turbine. A variable throat mechanism rotates the nozzle vanes to adjust the flow rate of the exhaust gas. The velocity of exhaust gas is increased by throttling the exhaust flow with the variable blade angle nozzle vanes so that high output can be obtained even at low rotation speed, and constituent members of an exhaust guide assembly of the turbocharger are surface-treated to coat the surfaces with carbide or nitride.

However, in the art of patent literature 1, the connection pin or pins are formed either on the lever plate or on the drive ring by extrusion or by precision casting such that the connection pin or pins are formed in one piece with the parent material, i.e. the lever plate or drive ring. But there is disclosed no countermeasure to deal with wear of the connection pin and groove of the link plate in which the connection pin is engaged.

Further, in the art, the drive ring is disposed adjacent to the nozzle mount in the axial direction between the side face of the lever plate and the side face of the nozzle mount. But there is disclosed no countermeasure to prevent slipping-off of the drive ring from the nozzle mount towards the lever plate side.

In the art disclosed in patent literature 2 is taught surface-treating of the constituent members of the exhaust guide assembly to coat the surfaces with carbide or nitride, but concretively only the coating of the variable blade angle nozzle vanes and the turbine frame is recited. Surface treating of transmission members for transmitting rotational force to the variable blade angle nozzle vanes via movable members is not disclosed.

Further, in the art of patent literature 2, a ring member is provided to sandwich a rotating member between the ring member and a flange of the turbine frame and push the rotating member towards the turbine frame to prevent the rotating member from moving apart from the turbine frame. Therefore, it is necessary to provide the ring member, resulting in an increase in cost and weight, and further resulting in complication during assembly.

SUMMARY OF THE INVENTION

The present invention was made in light of the problem in the prior art to improve on the art disclosed in patent literature 1 and 2. The object of the invention is to provide a variable-throat exhaust turbocharger in which connection pin parts which are formed integral with the lever plates or the drive ring and grooves into which the connection pin parts are engaged are treated to reduce abrasion of their contact surfaces. A further object is to provide a means to prevent slipping out of the drive ring from the nozzle mount toward the lever plate side to prevent the probable occurrence of failure in action of the variable nozzle mechanism caused by the slipping out of the drive ring.

To attain the objects, the present invention proposes a variable-throat exhaust turbocharger equipped with a variable throat mechanism comprising a plurality of nozzle vanes supported rotatably by a nozzle mount fixed to a turbine casing. An annular drive ring is connected to and rotated by an actuator. Lever plates, identical in number with the number of the nozzle vanes, are each connected at their one end to the drive ring via a connection pin and a groove into which the connection pin is engaged and at the other end connected to the nozzle vanes. The lever plates are swung by rotating the drive ring and the nozzle vanes are rotated by the swing of the lever plates to vary the blade angle of the nozzle vanes. A connection pin is formed integral with the lever plate by extrusion or by precision casting as a connection pin part of the lever plate, or the connection pins are formed integral with the drive ring by extrusion or by precision casting as connection pin parts of the drive ring. At least either the connection pin part of the lever plate/pin parts of the drive ring or grooves of the drive ring/groves of the lever plates into which the connection pin parts are engaged are treated with surface hardening including diffusion coating.

In the invention, it is preferable that the drive ring is disposed between the lever plates and the nozzle mount side by side with the lever plates and nozzle mount in the axial direction thereof. A connection pin part or parts are formed protruding from a side face of the lever plate or the drive ring and integral with the material of the lever plate or the drive ring. The connection pin parts of the lever plates or pin parts of the drive ring are engaged into the grooves of the drive pins or grooves of the lever plates.

The invention proposes a method for manufacturing a variable-throat exhaust turbocharger equipped with a variable throat mechanism constructed as mentioned above. A connection pin part is formed on a lever plate in one piece with the lever plate by pressing a spot on a flat face thereof to allow the pin part to be protruded from the other side flat face thereof or is formed by precision casting on a flat face of a lever plate in one piece with the lever plate. Or, a plurality of connection pin parts are formed on a drive ring in one piece with the drive ring by pressing a plurality of spots on a flat face thereof to allow the pin parts to be protruded from the other side flat face of the drive ring, or are formed by precision casting on a flat face of the drive ring in one piece with the drive ring. At least either the connection pin part of the lever plate/pin parts of the drive ring or grooves of the drive ring/groves of the lever plates are treated with surface hardening including diffusion coating.

According to the invention, the connecting pin parts can be easily formed integral with the parent material, the lever plates or drive ring, by using as a material of the lever plate or the drive ring a steel material that is tough but relatively soft and easy to process by extrusion and applying extrusion forming to either the lever plates or the drive ring, or by precision casting. Further, by treating at least the connection pin parts or the grooves, into which the connection pin parts are to be engaged, with surface hardening including diffusion coating, their contact surfaces are increased in hardness and abrasion of the contact surfaces is reduced.

Thus, the connection pin part of each of the lever plates or parts of the drive ring can be easily formed integral with each of the lever plates or drive ring by extrusion, consisting of one stage of processing or by precision casting, while attaining high durability of the contact surfaces of the connection pin parts and grooves by increasing the hardness of the contact surfaces to suppress abrasion of the contact surfaces. The result is that assembly man-hours and assembly cost can be reduced and the number of parts and manufacturing cost of the parts can be reduced as compared with a variable throat mechanism in which the connection pins are provided separately and fixed to the lever plates or drive ring.

In the invention, it is preferable that the drive ring is disposed between the lever plates and nozzle mount side by side with the lever plates and nozzle mount in the axial direction thereof. Rivets are fixed to the nozzle mount at its outer side face so that the outer side face of the drive ring can come into contact with the seating faces of the rivets to thereby prevent the drive ring from moving axially.

Further, it is preferable that recesses are formed to extend across the outer side face of the drive ring and outer side face of the nozzle mount, and the head of each of the rivets is received in the recesses.

According to this invention, slipping out of the drive ring in the axial direction can be positively prevented by such an extremely compact, cost saving, and light-in-weight means as fixing a plurality of rivets to the side face of the nozzle mount. The result is that the occurrence of failed action of the nozzle throat mechanism caused by slipping out of the drive ring in the axial direction can be prevented.

It is preferable that the drive ring is disposed between the lever plates and the nozzle mount side by side with the lever plates and nozzle mount in the axial direction thereof. A plurality of partial circumferential grooves are provided at the outer side part of the nozzle mount, the drive ring being received in the partial circumferential grooves and preventing the drive ring from moving in the axial direction.

It is also preferable that a plurality of engaging portions are provided. The engaging portions are composed of convex portions and concave portions provided either to the drive ring or nozzle mount respectively, so that the drive ring can be fitted to the nozzle mount by matching the convex portions and concave portions and shifting axially the drive ring relative to the nozzle mount. The drive ring is thereby allowed to be engaged into the partial circumferential grooves by shifting the drive ring in the rotation direction after the drive ring is fitted to the nozzle mount.

A method of manufacturing a variable-throat exhaust turbocharger equipped with a variable throat mechanism constructed as mentioned above is characterized in that a drive ring is disposed between the lever plates and the nozzle mount. The nozzle mount is provided with a plurality of partial circumferential grooves at the outer side part thereof, side by side with the lever plates and the nozzle mount in axial direction thereof. A plurality of engaging portions are provided, the engaging portions being composed of convex portions and concave portions provided either to the drive ring or nozzle mount, respectively. The drive ring can be fitted to the nozzle mount by matching the convex portions and concave portions and shifting axially the drive ring relative to the nozzle mount. The drive ring is thereby allowed to be engaged into the partial circumferential grooves by shifting the drive ring in the rotation direction by a certain angle after the drive ring is fitted to the nozzle mount to thereby prevent the drive ring from slipping out axially. The lever plates are attached to the drive ring and connected with nozzle shafts of the nozzle vanes. The nozzle shafts penetrate the nozzle mount, with the nozzle mount sandwiched with the lever plates and nozzle vanes.

According to the invention, the drive ring can be positively prevented from slipping out in the axial direction in a manner that requires no additional parts, and therefore does not result in an increase in the number of parts and cost, by engaging the drive ring in the partial circumferential grooves formed at the side part of the nozzle mount. The occurrence of failure inaction of the variable throat mechanism can thus be prevented.

Further, it is preferable that a coating layer is formed either on the surface of the connection pin part or on the surface of the groove into which the connecting part is engaged by PVD processing (physical vapor deposition processing) or by CVD (chemical vapor deposition processing).

According to the this invention, by forming a hard coating layer on the contact surface of the connection pin part and the groove into which the connection pin part is engaged by PVD or CVD processing, the wear resistance of the contact surface is increased.

According to the present invention, the hardness of the contact surface of the connection pin part and the groove into which the connection pin part is engaged can be increased by treating the contact surface with surface hardening including diffusion coating. Therefore, each of the connection pin parts can be easily formed integral with each of the lever plates or the drive ring by extrusion, consisting of one stage of processing, or by precision casting, while attaining high durability of the contact surface by increasing the hardness of the contact surface to suppress abrasion of the contact surface. The result is that assembly man-hours and assembly cost can be reduced and the number of parts and manufacturing cost of the parts can be reduced as compared with a variable threat mechanism in which the connection pins are provided separately and fixed to the lever plates or the drive ring.

As to surface hardening, in the case of steel-to-steel contact, the contact surface tends to be seriously worn by the occurrence of adhesion (adhesive wear). But when the surface of a member of contacting members is treated with surface hardening, the surface is hardened by the generation of ceramics or intermetallic compounds on the surface and adhesive wear is alleviated. As surface coarsening caused by sliding contact is prevented by surface hardening, the occurrence of scratches on the surface can be lessened and the occurrence of abrasive wear can be alleviated, even when the surface of the other member of the contacting members is not treated with surface hardening.

Therefore, a reduction of wear of the contact surface can be expected by treating only the surface of one member of the contacting members with surface hardening.

Further, according to the invention, the drive ring can be positively prevented from slipping out in the axial direction and the occurrence of failure in action of the variable throat mechanism can be prevented, by such an extremely compact and cost saving manner as to fix a plurality of rivets to a side face of the nozzle mount, or in such a manner that requires no additional parts and therefore does not result in an increase in the number of parts and cost, by engaging the drive ring into the partial circumferential grooves formed at a side part of the nozzle mount.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only and not limitative of the scope of the present invention.

Figure 5:
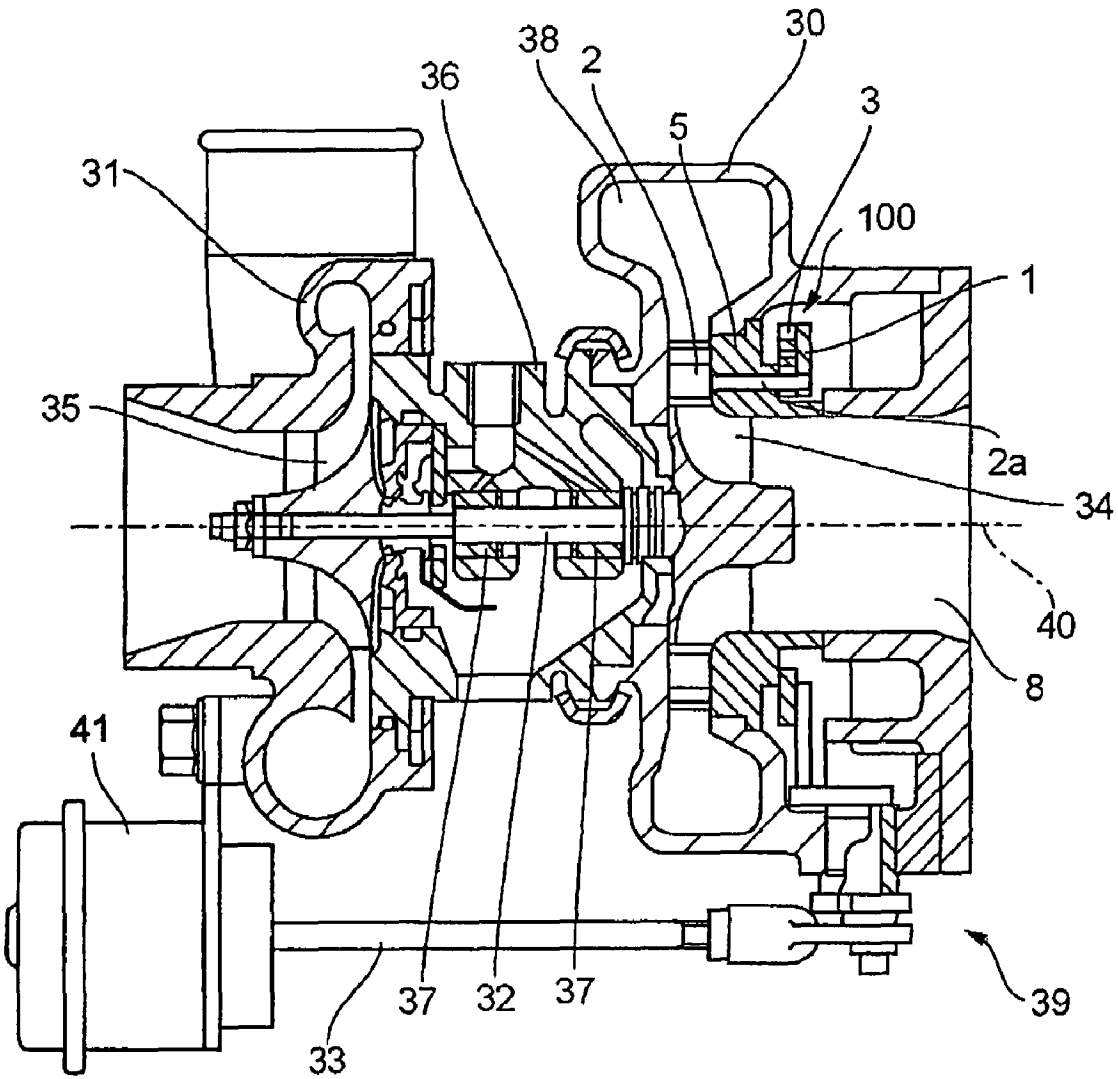
FIG. 5 is a longitudinal sectional view of a variable-throat turbocharger equipped with the variable throat mechanism according to the present invention.

FIG. 5 is a longitudinal sectional view of a variable-throat turbocharger equipped with a variable throat mechanism according to the present invention.

Referring to FIG. 5, reference numeral 30 is a turbine casing and 38 is a vortical scroll formed in the peripheral part of the turbine casing 30. Reference numeral 34 is a turbine rotor of a radial flow type, 35 is a compressor, 32 is a turbine shaft connecting the turbine rotor 34 to the compressor 35, 31 is a compressor housing, and 36 is a bearing housing.

The turbine shaft connecting the turbine rotor 34 to the compressor 35 is supported rotatably by the bearing housing 36 by means of two bearings 37, 37. Reference numeral 8 is an exhaust gas outlet and 40 is an axis of rotation of the exhaust turbo charger.

Reference numeral 2 is a nozzle vane. A plurality of the nozzle vanes are arranged at equal spacing on the inward side periphery of the scroll 38. A nozzle shaft 2*a* formed at a side face of the nozzle vane is supported rotatably by a nozzle mount 5 fixed to the turbine casing 30.

Reference numeral 41 is an actuator, 33 is an actuator rod, and 39 is a drive mechanism connecting the actuator rod 33 to a drive ring 3. The drive mechanism 39 converts reciprocating movement of the actuator rod into rotational movement of the drive ring.

Reference numeral 100 is a variable throat mechanism for varying the blade angle of the nozzle vanes 2.

In the operation of the variable-throat exhaust turbocharger equipped with the variable throat mechanism constructed as shown in FIG. 5, exhaust gas from an internal combustion engine (not shown in the drawing) enters the scroll 38 to flow along the volute of the scroll 38. The exhaust gas flows through passages between the nozzle vanes 2 into the turbine rotor 34 from the outer periphery thereof to flow radially inwardly, exerting expansion work on the turbine rotor 34, to be exhausted in axial direction through the exhaust gas outlet 8 to the outside.

Control of the variable-throat turbocharger is carried out by the actuator 41, which acts to change the blade angle of the nozzle vanes 2 to an angle position so that the exhaust gas flows through the passage between the nozzle vanes 2 at a desired flow rate. The blade angle is determined by a blade angle control means not shown in the drawing. Reciprocal displacement of the actuator rod 33 is converted to rotational displacement of the drive ring 3 by the medium of the drive mechanism 39.

By the rotation of the drive ring 3 each of lever plates 1 is swung around the center axis of each of the nozzle shafts 2*a* via each of connecting pin parts 10 (or 11) to rotate each of the nozzle shafts 2*a*. The nozzle vanes 2 are rotated by the rotation of the nozzle shafts 2*a* to change the blade angle to the desired angle position.

The present invention relates to an improvement of the variable throat mechanism 100 for controlling the flow rate of exhaust gas flowing through the variable-throat turbine in this manner.

First Embodiment

Figure 1B:
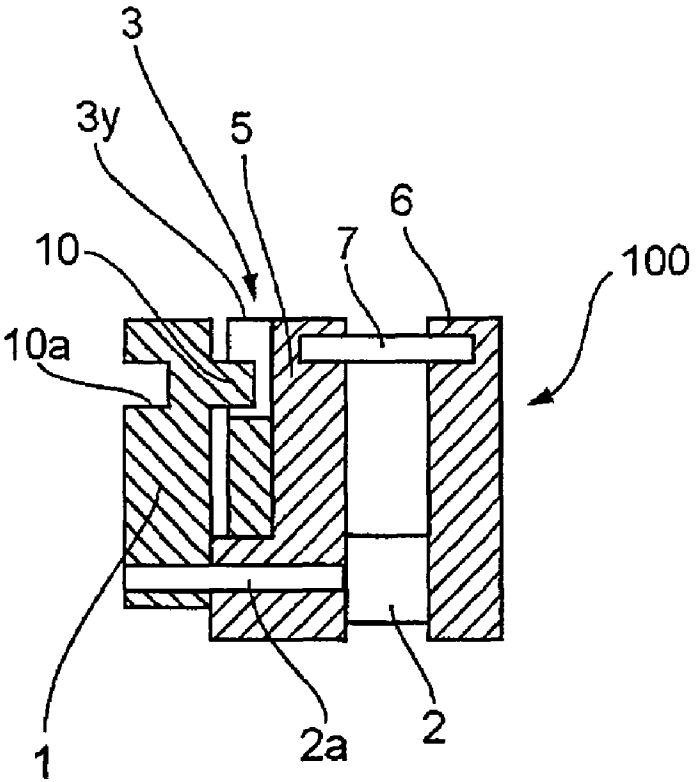
FIG. 1B is a sectional view along line A-A in FIG. 1A.
Figure 1A:
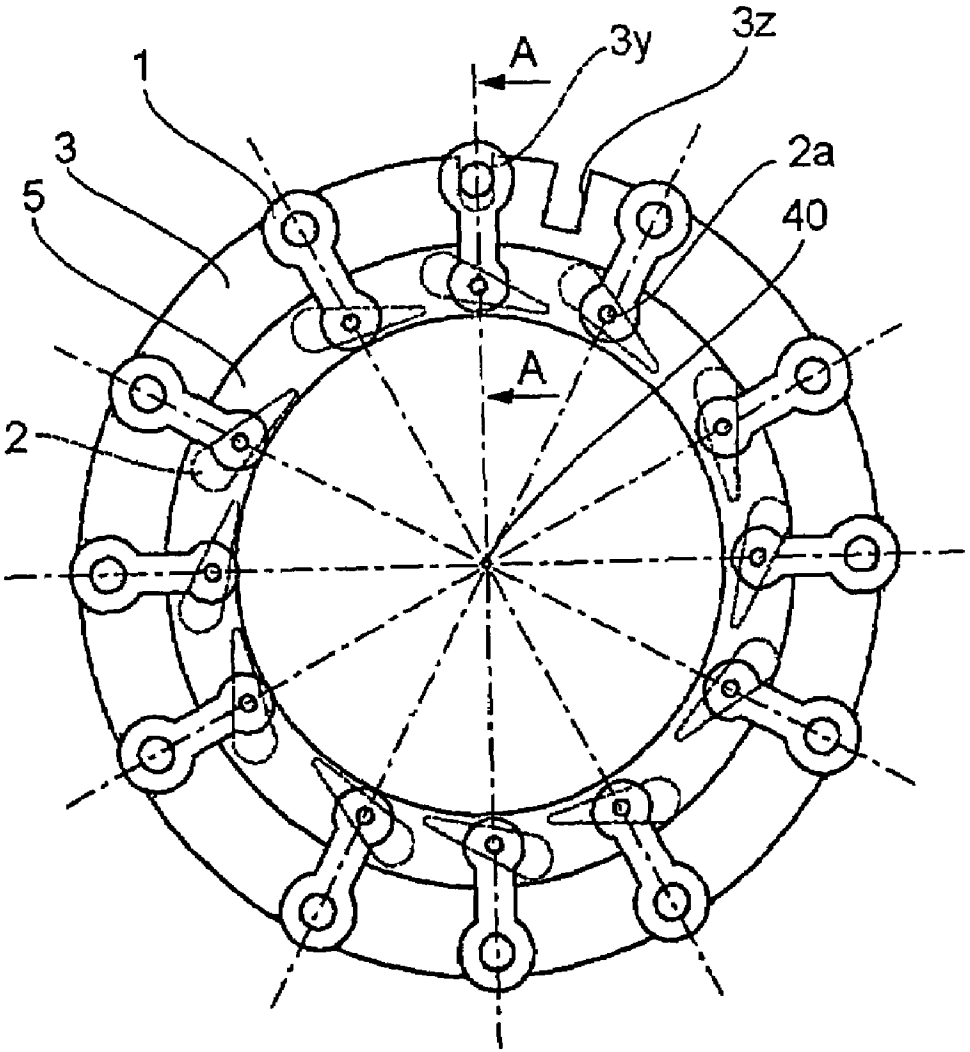
FIG. 1A is a front view of a first embodiment of the variable throat mechanism of the present invention viewed from a lever plate side.

FIG. 1A is a front view of the first embodiment of the variable throat mechanism of the present invention viewed from the lever plate side, and FIG. 1B is a sectional view along line A-A in FIG. 1A.

Reference numeral 100 is a variable nozzle mechanism for varying the blade angle of the nozzle vanes 2 and constructed as follows.

Reference numeral 3 is the drive ring formed in an annular shape and supported rotatably by the nozzle mount 5. Grooves 3*y* (only one of which is shown for ease of illustration) are provided at the peripheral part of the drive ring 3 at equal spacing, and each of connecting pin parts 10, explained later, is engaged with a respective one of the grooves 3*y*. Reference numeral 3*z* is a driving groove with which a link of the drive mechanism 39 is engaged.

Reference numeral 1 indicates the lever plates, disposed on the peripheral part of the drive ring 3 and corresponding to the grooves 3*y* in number.

Each of the lever plates 1 has a connecting pin part 10 formed on its face at a circumferentially outward side, and the nozzle shaft 2*a* of the nozzle vane 2 is fixed to the lever plate 1 at the inward side thereof.

Reference numeral 6 is a support plate formed into an annular shape and 7 indicates nozzle supports for connecting the support plate 6 to the nozzle mount 5.

In the variable nozzle throat mechanism 100, as shown in FIG. 1B, the lever plate 1 is disposed at an axially outer side (exhaust gas outlet 8 side in FIG. 5). The drive ring 3 is disposed between a side face of the lever plate 1 and a side face of the nozzle mount 5 to be side by side with the lever plates 1 and the nozzle mount 5 in the axial direction thereof.

The connecting pin part 10 is formed by extrusion, in which a spot on a flat face of the lever plate 1 is pressed by a pressing machine to form a depressed portion 10*a* thereon to obtain a cylindrical projecting part on the other side flat face thereof. Thus the connecting pin part 10 is formed in one piece with parent material, i.e. the lever plate 1.

The lever plate can be also made by precision casting to have the connecting pin part 10 integral with the lever plate.

At least one of the periphery of the connection pin part 10 and the surface of the groove 3*y*, into which is to be engaged the connecting pin part 10, of the drive ring 3, is treated by surface hardening such as chrome diffusion coating, aluminum diffusion coating, vanadium diffusion coating, niobium diffusion coating, boron diffusion coating, nitriding, or combined treating of the diffusion coating and carburizing.

To manufacture the variable throat mechanism 100 constructed as mentioned above, a connection pin part 10 is formed to protrude from the lever plate 1 in one piece therewith by pressing with a pressing machine a spot on a flat face of the lever plate 1 so that a cylindrically depressed portion 10*a* is formed on the other side flat face of the lever plate. On the drive ring 3 are formed the grooves 3*y* by machining, or the grooves 3*y* are formed by precision casting when the drive ring is made by precision casting.

Then, at least one of the periphery of the connection pin part 10 and the surface of the groove 3*y*, into which the connecting pin part 10 is to be engaged, of the drive ring 3, is treated for surface hardening as mentioned above.

Second Embodiment

Figure 2B:
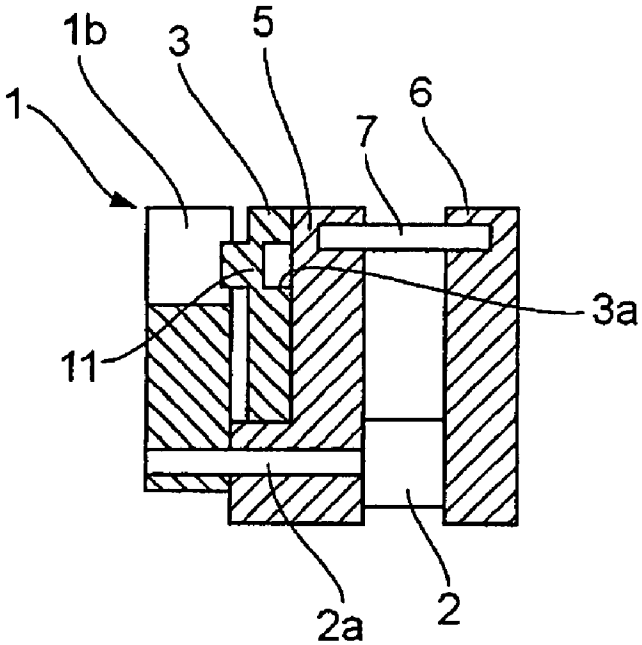
FIG. 2B is a sectional view along line A-A in FIG. 2A.
Figure 2A:
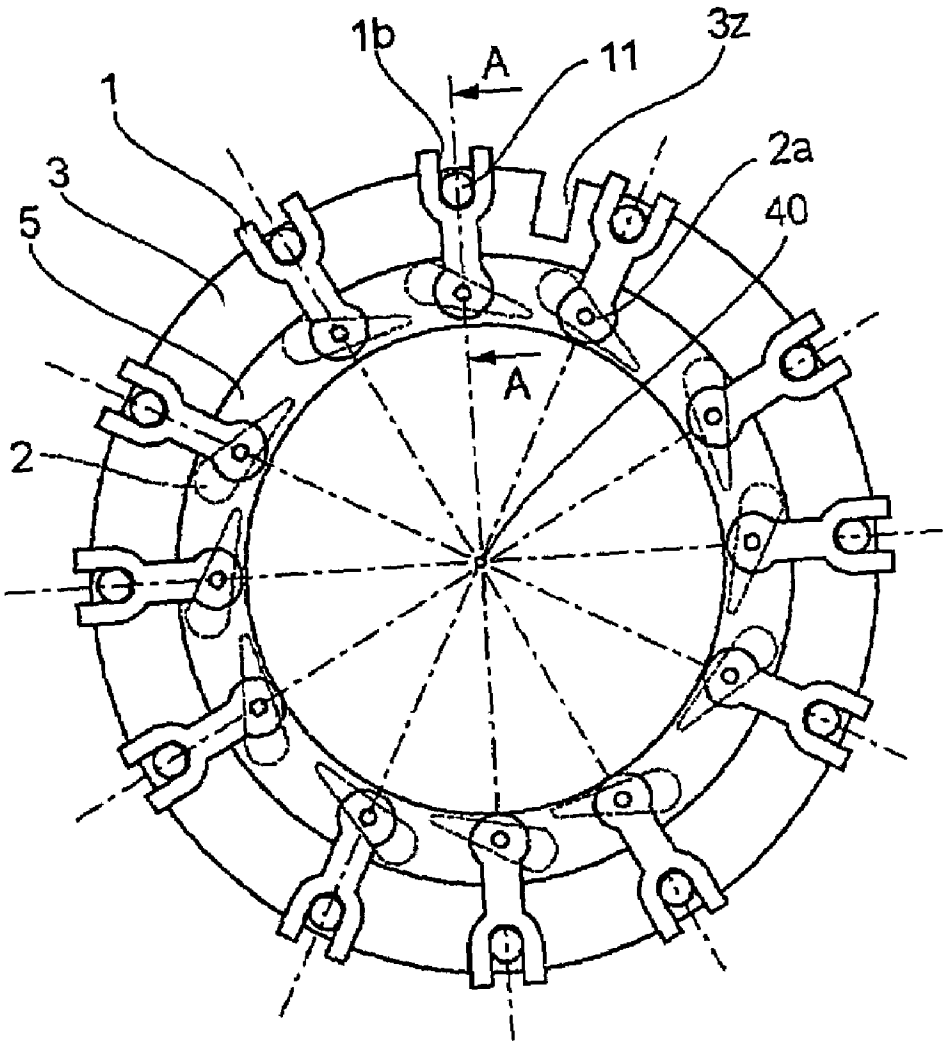
FIG. 2A is a front view of a second embodiment of the variable throat mechanism of the present invention viewed from the lever plate side.

FIG. 2A is a front view of a second embodiment of the variable throat mechanism of the present invention viewed from the lever plate side, and FIG. 2B is a sectional view along line A-A in FIG. 2A.

In the second embodiment, a plurality of spots lining up circumferentially at equal spacing on a flat face of a drive ring 3 are pressed by a pressing machine to form cylindrical depressed portions 3*a*, each of which is similar to that of the first embodiment to obtain cylindrical projecting parts on the other side flat face thereof. Thus connecting pin parts 11 are formed in one piece with parent material, i.e. the drive ring 3. Each of the lever plates 1 is formed to have a two-forked part at the outward side thereof to form a groove 1*b* to be engaged with one of the connecting pin parts 11 of the drive ring 3.

Otherwise this embodiment is identical in construction to the first embodiment, and constituent parts similar to those of the first embodiment are denoted by the same reference numerals, respectively.

According to the first and second embodiments, the connecting pin parts 10 (11) can be easily formed integral with the parent material by using, as material of the lever plate 1 or the drive ring 3, steel material that is tough but relatively soft and easy to process by extrusion and applying extrusion forming to either the lever plate 1 or drive ring 3, or by precision casting.

Further, by treating at least the connection pin parts 10 (11) or the grooves, into which the connection pin parts 10 (11) are to be engaged, with surface hardening including diffusion coating, their contact surfaces are increased in hardness and the occurrence of adhesion between the surfaces of the grooves and the connecting pin parts is prevented, with the result that abrasion of the contact surface of the connecting pin parts 10 (or 11) and grooves 3*y* (or 1*b*) can be reduced.

Thus, each of the connection pin parts 10 or parts 11 can be easily formed integral with each of the lever plates 1 or drive ring 3 by extrusion consisting of one stage of processing or by precision casting while attaining high durability of the contact surface by increasing the hardness of the contact surfaces of connection parts 10 (or 11) and grooves 3*y* (or 1*b*) to suppress wear of the contact surfaces. The result is that assembly man-hours and assembly cost can be reduced and the number of parts and manufacturing cost of the parts can be reduced as compared with a variable throat mechanism in which the connection pins are provided separately and fixed to the lever plates or drive ring.

Third Embodiment

Figure 3B:
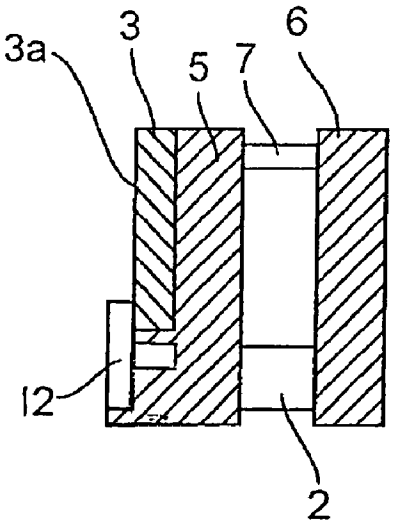
FIG. 3B is a sectional view along line A-A in FIG. 3A.
Figure 3C:
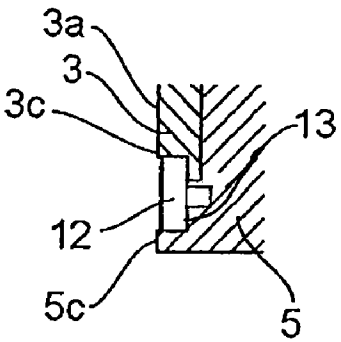
FIG. 3C is a sectional view as along line C-C in FIG. 3A of a modification of the third embodiment.
Figure 3A:
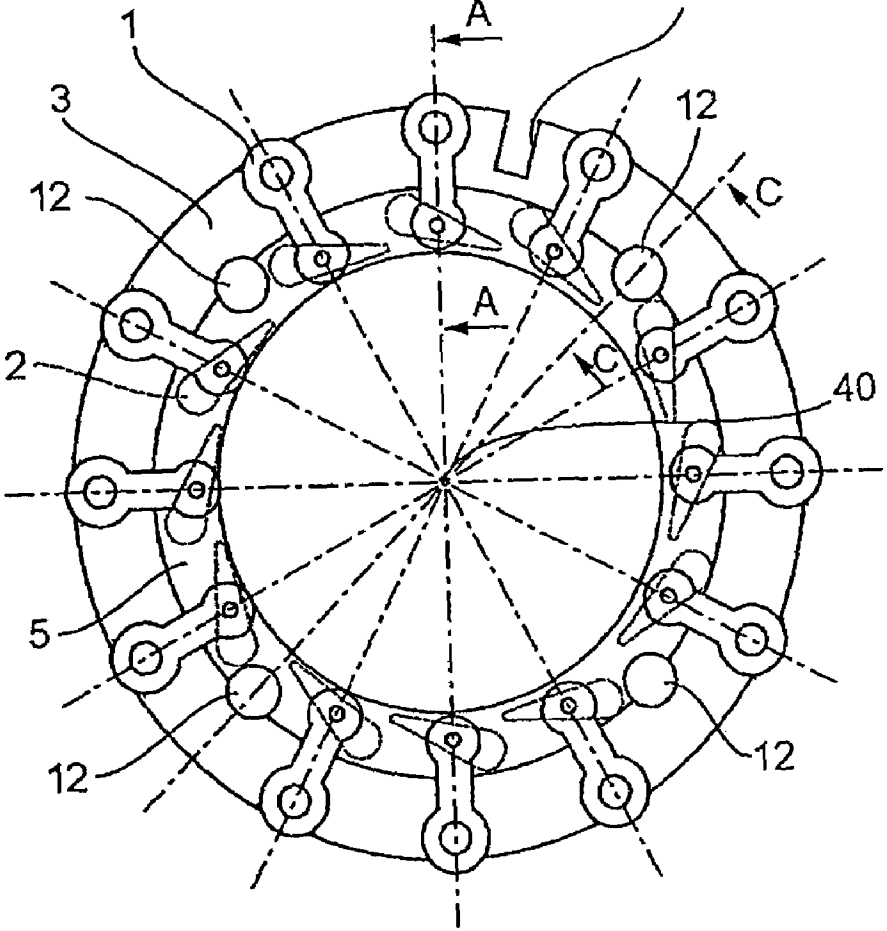
FIG. 3A is a front view of a third embodiment of the variable throat mechanism of the present invention viewed from the lever plate side.

FIG. 3A is a front view of a third embodiment of the variable throat mechanism of the present invention viewed from the lever plate side and FIG. 3B is a sectional view along line A-A in FIG. 3A. FIG. 3C is a sectional view as along line C-C in FIG. 3A of a modification of the third embodiment. A section along line A-A in FIG. 3A of the third embodiment is the same as that shown in FIG. 1B and FIG. 2B.

In the third embodiment, a drive ring 3 is disposed between the side face of the lever plate 1 and a side face of a nozzle mount 5 to be side by side with the lever plates 1 and nozzle mount 5 in the axial direction thereof as in the case of the first and second embodiments. A plurality of rivets 12 are fixed to the nozzle mount 5 at its outer side face so that the outer side face 3*a* of the drive ring 3 can come into contact with the seating faces of the rivets 12 to thereby prevent the drive ring from slipping out towards the lever plate side.

In the third embodiment, it is also possible that recesses 13 are formed to extend across the outer side face 3*c* of the drive ring 3 and outer side face 5*c* of the nozzle mount 5, with the head of each of the rivets being received in the recesses to thereby avoid the heads of the rivets from protruding toward the outer side face of the lever plate 1.

According to the third embodiment, slipping out of the drive ring 3 in the axial direction can be positively prevented by such an extremely compact, cost saving, and light-in-weight means as a plurality of rivets 12 (four rivets in the example shown in FIG. 3A) fixed to a side face of the nozzle mount 5. The result is that the occurrence of failed action of the nozzle throat mechanism 100, caused by slipping out of the drive ring 3 in the axial direction, is avoided.

Otherwise this embodiment is identical in construction to the first embodiment, and constituent parts similar to those of the first embodiment are denoted by the same reference numerals, respectively.

Fourth Embodiment

Figure 4B:
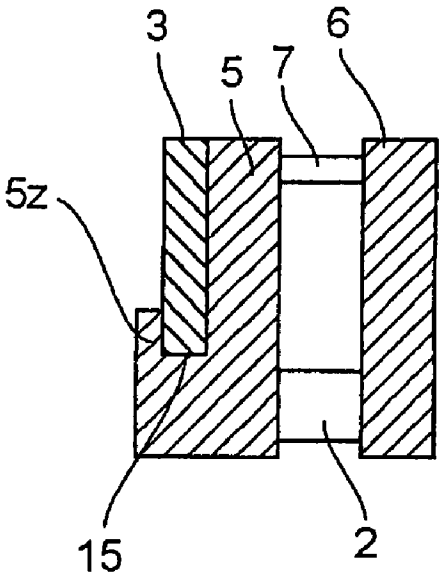
FIG. 4B is a sectional view along line D-D in FIG. 4A.
Figure 4A:
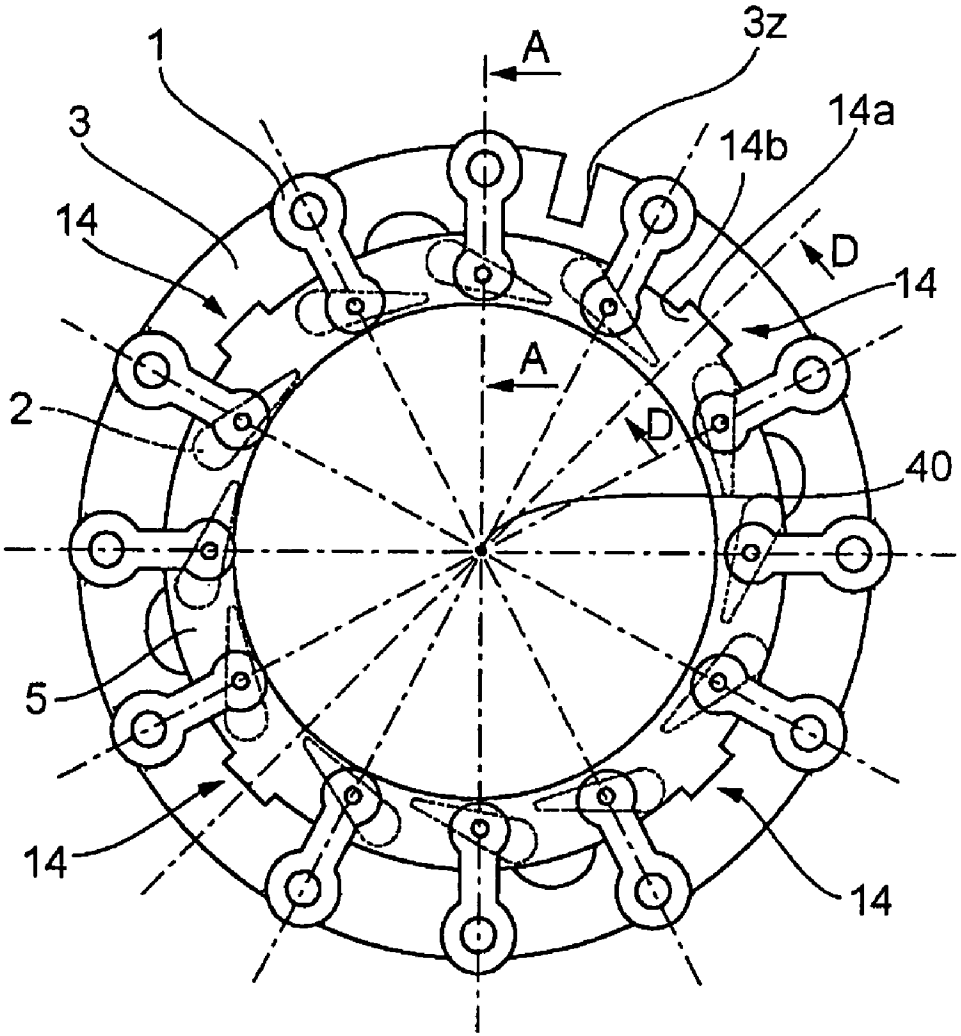
FIG. 4A is a front view of a fourth embodiment of the variable throat mechanism of the present invention viewed from the lever plate side.

FIG. 4A is a front view of a fourth embodiment of the variable throat mechanism of the present invention viewed from the lever plate side, and FIG. 4B is a sectional view along line D-D in FIG. 4A. A section along line A-A in FIG. 4A of the fourth embodiment is the same as that shown in FIG. 1B.

In the fourth embodiment, a drive ring 3 is disposed between the side face of the lever plate 1 and the side face of the nozzle mount 5 to be side by side with the lever plates 1 and the nozzle mount 5 in the axial direction thereof as in the case of the first and second embodiments. A plurality of partial circumferential grooves 15 are provided at the outer side part of the nozzle mount 5. The drive ring 3 is received in the partial circumferential grooves 15 and prevented by the side face of the groove 15 from slipping out towards the lever plate 1.

More specifically, as shown in FIG. 4A, a plurality of engaging parts 14 are provided which consist of a plurality of concave portions 14*a* formed on the inner periphery of the drive ring 3 and a plurality of convex portions 14*b* formed at the outer side face part 5*z* of the nozzle mount 5. The convex portions 14*b* form outside walls of the partial circumferential grooves 15 and the bottoms of the partial circumferential grooves 15 coincide with the outer periphery of the stepped part of the nozzle mount 5.

When assembling the variable throat mechanism 100 of the fourth embodiment, the drive ring 3 is pushed towards the nozzle mount with the concave portions 14*a* of the drive ring 3 matched with the convex portions 14*b* of the nozzle mount 5 to fit the drive ring 3 on the inner periphery of the stepped part of the nozzle mount 5. Then the drive ring 3 is rotated by a certain rotation angle relative to the nozzle mount 5 so that the inner peripheral part of the drive ring is engaged with the partial circumferential grooves 15 to prevent the drive ring 3 from slipping in the axial direction. Then the lever plates 1 are attached to the drive ring 3 and connected with the nozzle shafts 2*a* penetrating the nozzle mount 5, sandwiching the nozzle mount 5.

Otherwise this embodiment is identical in construction to the first embodiment, and constituent parts similar to those of the first embodiment are denoted by the same reference numerals, respectively.

According to the fourth embodiment, the drive ring 3 can be positively prevented from slipping out in the axial direction in such a manner that requires no additional parts and therefore does not result in an increase in the number of parts and cost. By engaging the drive ring 3 into the partial circumferential grooves 15 formed at the side part 5*z* of the nozzle mount 5, the occurrence of failure in action of the variable throat mechanism can be prevented.

Fifth Embodiment

In the fifth embodiment of the invention, in the variable exhaust turbocharger equipped with the variable nozzle throat mechanism 100 as shown in FIG. 1 to FIG. 4, a coating layer is formed either on the surface of the connection pin part 10 (or 11) or on the surface of the groove 3*y* (or 1*b*), (or on both the surfaces) by PVD processing (physical ion adsorption processing) or by CVD (chemical ion adsorption processing).

According to the fifth embodiment, by forming a hard coating layer on the contact surface of the connection pin part 10 (or 11) with the groove 3*y* (or 1*b*) into which the connection pin part 10 is engaged by PVD or CVD processing, the abrasive resistance of the contact surface is increased.

According to the present invention, a variable-throat exhaust turbocharger can be provided, in which is used a means to reduce wear of the contact surfaces of the connecting pin parts which are formed integral with the lever plates or the drive ring and the grooves into which the connection pin parts are engaged, and in which is provided a means to prevent slipping out of the drive ring from the nozzle mount toward the lever plate to prevent a probable occurrence of failure in action of the variable nozzle mechanism caused by the slipping out of the drive ring.

What is claimed is:

1. A variable-throat exhaust turbocharger equipped with a variable throat mechanism comprising a plurality of nozzle vanes supported rotatably by a nozzle mount fixed to a turbine casing, an annular drive ring connected to and rotated by an actuator, and lever plates identical in number with the number of the nozzle vanes, each of the lever plates being connected at one end to the drive ring via a connection pin and a groove into which the connection pin is engaged and at the other end to the nozzle vanes, whereby the lever plates are swung by rotating the drive ring and the nozzle vanes are rotated by the swing of the lever plates to vary the blade angle of the nozzle vanes, wherein said drive ring is disposed between said lever plates and nozzle mount side by side with the lever plates and nozzle mount in an axial direction thereof, and a plurality of partial circumferential grooves are provided at the outer side part of the nozzle mount, thereby receiving the drive ring in the partial circumferential grooves and preventing the drive ring from moving in the axial direction.

2. A variable-throat exhaust turbocharger equipped with a variable throat mechanism according to claim 1, wherein a plurality of engaging portions are provided, the engaging portions being composed of convex portions and concave portions provided either to the drive ring or nozzle mount respectively, so that the drive ring is fitted to the nozzle mount by matching the convex portions and concave portions and shifting axially the drive ring relative to the nozzle mount, whereby the drive ring is allowed to be engaged into said partial circumferential grooves by shifting the drive ring in a rotation direction after the drive ring is fitted to the nozzle mount.

3. A variable-throat exhaust turbocharger equipped with a variable throat mechanism comprising:

a nozzle mount fixed to a turbine casing;

a plurality of nozzle vanes rotatably supported by said nozzle mount;

an annular drive ring connected to and rotated by an actuator; and lever plates identical in number with said nozzle vanes, each of said lever plates being connected at one end of said lever plates to said drive ring via a connection pin and a groove into which the connection pin is engaged and at the other end of said lever plates to respective ones of said nozzle vanes so that said lever plates are swung by rotating said drive ring and said nozzle vanes rotated by the swinging of said plurality of lever plates so as to vary a blade angle of said nozzle vanes;

wherein said drive ring is disposed between said lever plates and said nozzle mount, so as to be side by side with said lever plates and said nozzle mount in an axial direction thereof; and wherein rivets are fixed to said nozzle mount at an outer side face of said nozzle mount so that an outer side face of said drive ring is in contact with seating faces of said rivets and said rivets prevent said drive ring from moving in the axial direction.

4. The variable-throat exhaust turbocharger equipped with a variable throat mechanism according to claim 3, wherein recesses extend across said outer side face of said drive ring and said outer side face of said nozzle mount, said recesses receiving heads of respective said rivets.

5. A method for manufacturing a variable-throat exhaust turbocharger equipped with a variable throat mechanism comprising a plurality of nozzle vanes rotatably supported by a nozzle mount fixed to a turbine casing, an annular drive ring connected to and rotated by an actuator, and lever plates identical in number with the nozzle vanes, the lever plates being connected at one end to the drive ring via a plurality of connection pins and a plurality of grooves into which the connection pins are engaged and at the other end to the nozzle vanes, whereby the lever plates are swung by rotating the drive ring and the nozzle vanes are rotated by the swinging of the lever plates to vary a blade angle of the nozzle vanes, said method comprising:

disposing the drive ring between the lever plates and the nozzle mount so as to be side by side with the lever plates and the nozzle mount in the axial direction thereof, the nozzle mount having a plurality of partial circumferential grooves at an outer side part thereof, by fitting the drive ring to the nozzle mount using engaging portions composed of convex portions on one of the drive ring and the nozzle mount and concave portions on the other of the drive ring and the nozzle mount by matching the concave portions and the convex portions and axially shifting the drive ring relative to the nozzle mount, then rotating the drive ring in a direction of rotation by a certain angle so as to engage the drive ring in the partial circumferential grooves to prevent axial slippage of the drive ring, and attaching the lever plates to the drive ring and connecting the lever plates with nozzle shafts of the nozzle vanes, the nozzle shafts penetrating the nozzle mount, with the nozzle mount sandwiched between the lever plates and the nozzle vanes.

* * * * *